United States Patent [19]

Dransfield

[11] Patent Number: 4,867,325

[45] Date of Patent: Sep. 19, 1989

[54] BABY BOTTLE

[75] Inventor: Julian E. G. Dransfield, San Pedro, Calif.

[73] Assignee: Glen E. Stankee, Wheatland, Iowa

[21] Appl. No.: 151,289

[22] Filed: Feb. 1, 1988

[51] Int. Cl.[4] ..... A61J 9/02; A61J 9/08

[52] U.S. Cl. ..... 215/11.2; 215/11.6; 374/150

[58] Field of Search ..... 215/6, 11.1–11.6, 215/100 A, 365; 374/150, 162; 116/216; D24/46, 47

[56] References Cited

U.S. PATENT DOCUMENTS

| | | | |
|---|---|---|---|
| 438,937 | 10/1890 | McKinnon | 215/11.1 |
| 598,231 | 2/1898 | Roderick | 215/11.5 |
| 3,125,984 | 3/1964 | Okuyama | 215/11.2 X |
| 3,145,867 | 8/1964 | Roberts et al. | 215/11.1 |
| 3,470,929 | 10/1969 | Thornton | 215/6 X |
| 3,864,976 | 2/1975 | Parker | 374/150 X |
| 4,447,164 | 5/1984 | Berndt | 374/162 |
| 4,637,934 | 1/1987 | White | 215/11.1 X |
| 4,676,387 | 6/1987 | Stephenson et al. | 215/11.1 |

FOREIGN PATENT DOCUMENTS

| | | | |
|---|---|---|---|
| 2291683 | 6/1976 | France | 215/11.2 |
| 11754 | of 1899 | United Kingdom | 215/6 |

*Primary Examiner*—Sue A. Weaver
*Attorney, Agent, or Firm*—Henderson & Sturm

[57] ABSTRACT

A baby bottle having a generally toroidal hollow chamber. The bottle preferably has a nipple which is positioned at an angle with respect to the toroidal chamber so that the bottle can rest in a highly stable manner on its side. Preferably, the bottle also has a bisecting tubular chamber which increases the capacity of the bottle while reducing the external size thereof. One or more liquid crystal temperature sensing dots may be molded in the side of the bottle to facilitate the determination of overheated contents. A flexible handled brush can be used to completely clean all inner surfaces of the bottle.

9 Claims, 1 Drawing Sheet

BABY BOTTLE

BACKGROUND OF THE DISCLOSURE

The field of the invention is baby bottles and the invention relates more particularly to baby bottles which may be more easily grasped by an infant during feeding and which also are far more resistant to being tipped over than conventional prior art baby bottles.

Most baby bottles are generally cylindrical, plastic bottles having a base at one end and a nipple at the other end. Such bottles are relatively hard for a small infant to grasp during feeding and, thus, it is common for the mother, or person feeding the child, to hold the bottle during feeding. Also, conventional baby bottles are easily tipped over. An easy-to-grip baby bottle is shown in U.S. Pat. No. 4,570,808. This bottle, however, is also unstable and easily tipped over. The outer surface available for heating a conventional baby bottle in hot water is limited by the shape of the bottle and a bottle having a greater surface area would reduce the time necessary to heat a bottle.

SUMMARY OF THE INVENTION

It is an object of the present invention to provide a baby bottle which may be more easily held by an infant, which is less likely to be tipped over and which has an enlarged surface area for warming the contents thereof.

The present invention is for a baby bottle having a generally foroidal hollow chamber with an opening for a nipple on the outer periphery thereof. A bisecting tubular chamber may be connected at each end thereof to the generally toroidal hollow chamber. Preferably, the opening for attachment of a nipple is at an angle of from about 20 to 60 degrees with respect to the central plane of the bottle. A bottle brush, having a flexible handle and a knob at its brush end, may be inserted through the opening of the bottle, first in a clockwise direction in the generally toroidal hollow chamber and secondly in a counter-clockwise direction. In the event of the bottle having a bisecting tubular chamber, then the brush may be also inserted directly through the central bisecting tubular chamber thereby cleaning all interior surfaces of the bottle.

DESCRIPTION OF THE PREFERRED EMBODIMENTS

Figure 1:
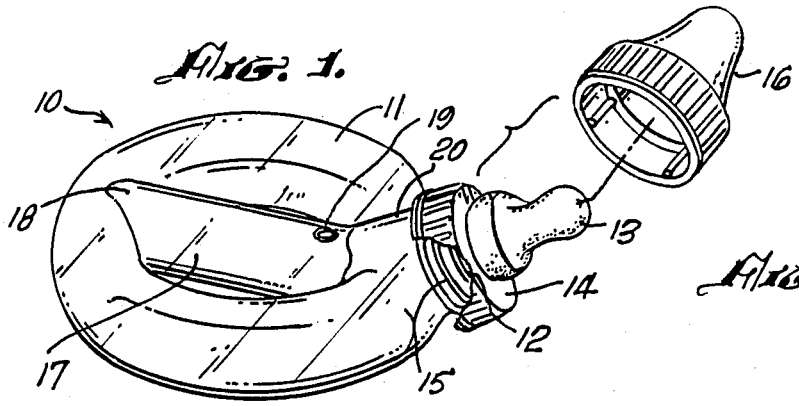
FIG. 1 is a perspective view of the baby bottle of the present invention having a nipple attached thereto and showing a cap serrated from the nipple.
Figure 7:
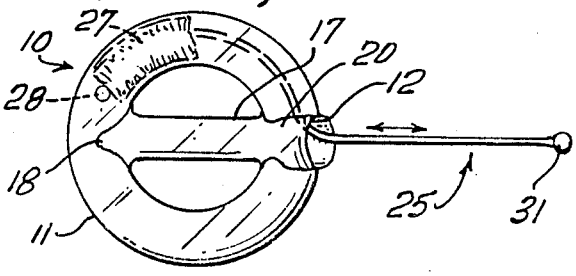
FIG. 7 is a diagrammatic view showing the brush of FIG. 5 cleaning the generally toroidal hollow chamber of the baby bottle of FIG. 1.

The baby bottle of the present invention is shown in FIG. 1 and indicated generally by reference character 10. Bottle 10 has a generally toroidal hollow chamber 11. Hollow chamber 11 has an opening 12 to which a nipple 13 is held by a threaded ring 14. Treaded ring 14 is broken away in FIG. 1. Opening 12 has threads 15 on the outer surface thereof which meet with the threads of threaded ring 14. A cap 16 may be snapped over threaded ring 14 and serves to protect the nipple as shown best in FIG. 3. A bisecting tubular chamber 17 passes from the inner surface of generally toroidal hollow chamber 11 at point 18 opposite the position of opening 12. Thus, as seen best in FIG. 2, chamber 17 generally bisects chamber 11. While chamber 11 has been referred to as a generally toroidal chamber, it may be oblong, ellipsoidal or other generally curved shape. It is important, however, that the inner surface of the hollow chamber 11 be smooth so that it may be readily and completely cleaned by a bottle brush as indicated in FIG. 7.

Figure 2:
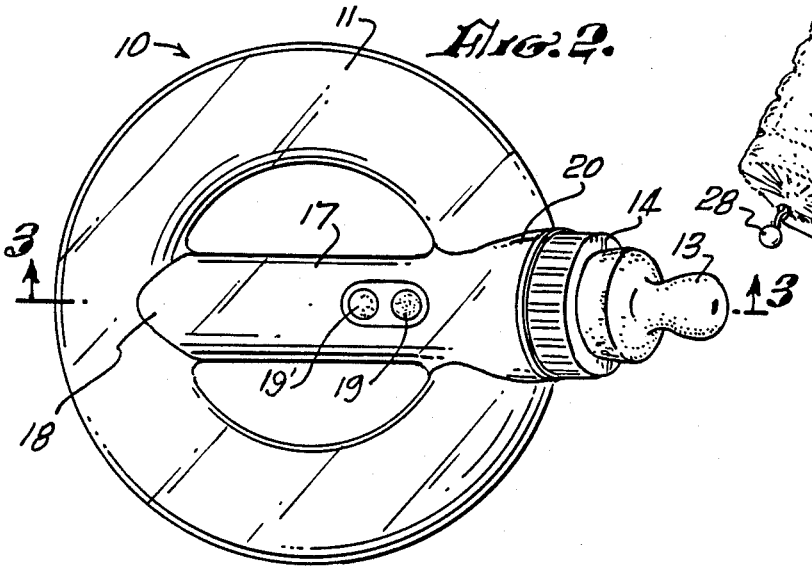
FIG. 2 is an enlarged plan view of the baby bottle and nipple of FIG. 1.

As shown in FIG. 1, a liquid crystal temperature sensor 19 is imbedded in the surface of baby bottle 10. The liquid crystal sensor is configured to change from a green color to a black color at 100 degrees Fahrenheit. Thus, if the contents of bottle 10 exceed 100 degrees Fahrenheit, the sensor 19 changes from green to black and the user knows that the contents are too warm for use. Although sensor 19 is shown as imbedded in the bisecting tubular chamber, it could, of course, be imbedded in the generally toroidal hollow chamber 11 or in the neck portion 20 of opening 12. As shown in FIG. 2, an additional sensor 19, may also be used which changes color when the contents of the bottle reach a sufficiently warm temperature for drinking.

Figure 4:
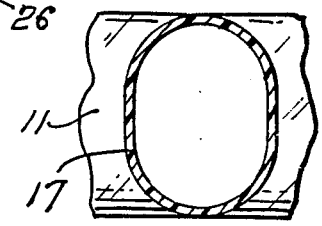
FIG. 4 is a cross-sectional view taken along line 4—4 of FIG. 3.

It can be seen in FIG. 4 that tubular chamber 17 is not circular in shape but is generally slightly oblong to facilitate the molding process. Preferably, the baby bottle of the present invention is fabricated by a blow molding process which provides a bottle having a particularly smooth inner surface as well as a bottle of reasonable molded cost.

Figure 3:
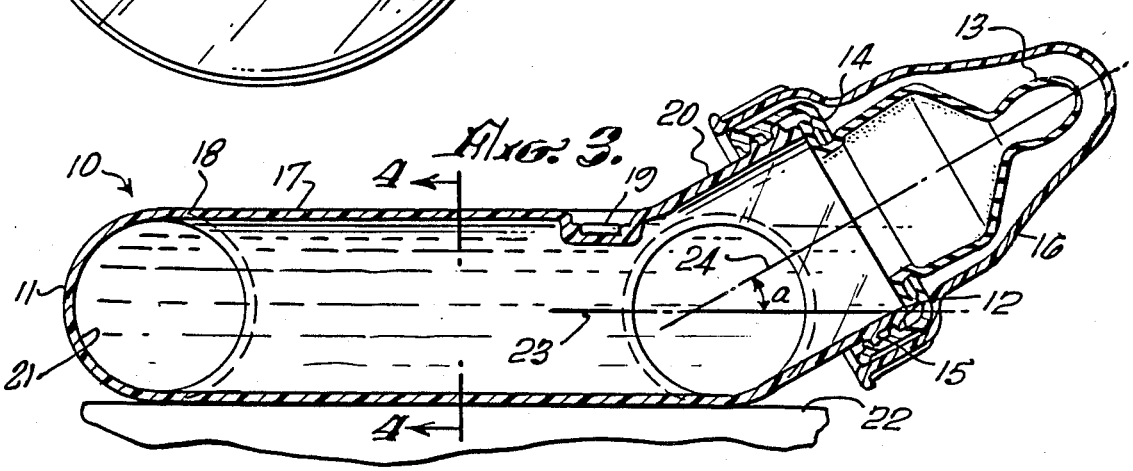
FIG. 3 is an enlarged cross-sectional view taken along line 3—3 of FIG. 2 and further including a nipple cover.
Figure 6:
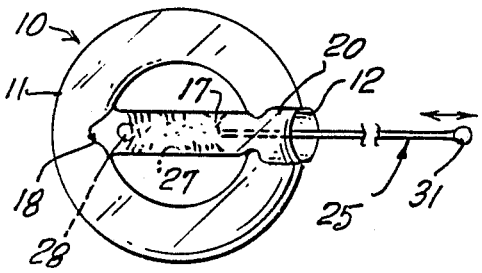
FIG. 6 is a diagrammatic view showing the brush of FIG. 5 cleaning the central bisecting tubular chamber of the baby bottle of FIG. 1.

As shown best in FIG. 3, the generally toroidal hollow chamber has an interior surface which is essentially a smooth circle as indicated by reference character 21 in FIG. 3. This provides a maximum of internal capacity while also being easy to clean. More importantly, the stable position of bottle 10 is indicated in FIG. 3 where a table surface 22 is shown supporting bottle 10. The central plane of bottle 10 is indicated by reference character 23 which is, of course, parallel to table surface 22. The nipple opening 12 has a central axis 24 which is at an angle indicated by reference character "a" in FIG. 3. Angle "a" is preferably between about 20 and 60 degrees and ideally between 30 and 40 degrees. In this way, the cap 16 does not touch the table surface 22 when the bottle 10 is resting on table surface 22. Furthermore, the feeding operation is facilitated in that the baby is more easily able to hold the nipple comfortably in his or her mouth because of angle "a." The bottle, of course, would be inverted when presented to the infant and this further facilitates the maintenance of liquid in the interior of nipple 13. Angle "a" also keeps milk away from the internal surface of the nipple 13 as shown in FIG. 3. Also, as the infant is holding the bottle, the angled nipple helps maintain milk at the internal surface of the nipple when the bottle is inverted.

Figure 5:
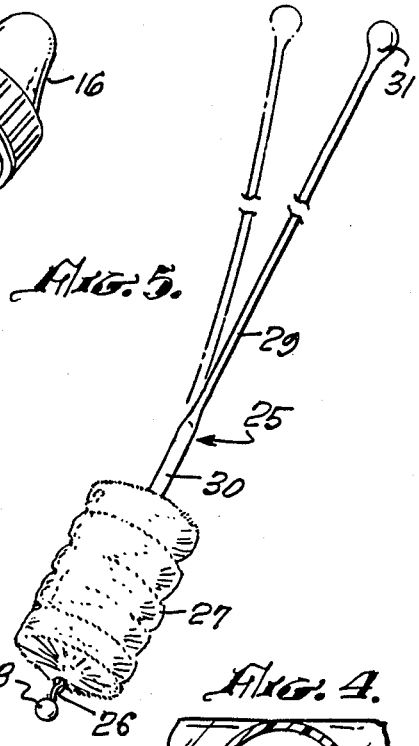
FIG. 5 is a perspective view of a brush useful in cleaning the interior of the baby bottle of FIG. 1.

The cleaning brush of the present invention is shown in FIG. 5 and indicated generally by reference character 25. Brush 25 has a conventional twisted wire portion 26 which holds a plurality of bristles 27. At the bristle, or brush end, of cleaning brush 25 is a plastic ball, or bulb, 28. This bulb helps guide the bristle portion of the brush down either the right or left side of the generally toroidal hollow chamber 11. The bulb and bristles are inserted through opening 12, and the bulb is either directed down the bisecting tubular chamber 17 or one of the two passageways in the generally toroidal hollow chamber 11. The twisted wire portion 26 is attached to a flexible plastic rod 29 by way of a hollow plastic tube 30 which is fabricated from a flexible plastic such as plasticized poly vinyl chloride. Alternatively, the brush may be made from a single plastic molding where the bristles are integral with plastic rod 29. Flexible handle 29 may be fabricated from a solid plastic material such as impact polystyrene or from any non-toxic, relatively stiff but still flexible material. A larger bulb 31 is molded on the end of flexible handle 29 to facilitate the pushing of the bristles 27 through the appropriate passageway. It can readily be seen that the interior of bottle 10 is smooth and easily reached by the bristles of the brush. Bulb 28 helps guide the brush through the interior of bottle 10.

In order to maximize the inner volume of bottle 10, it is preferable that the inside diameter of bisecting tubular chamber 17 be about the same as the inner diameter of the generally toroidal hollow chamber 11. Preferably, the capacity of the bottle is about 8 ounces and because of the presence of the bisecting tubular chamber 17, the overall size of the bottle is still relatively small. It is also preferable that the inside diameter of opening 12 be at least as large as the inside diameter of either the generally toroidal hollow chamber 11 or the bisecting tubular chamber 17.

The surface area of the bottle of the present invention is particularly large as compared to the conventional cylindrical bottle. For instance, the approximate surface area of a cylindrical 8-ounce bottle having a 2.5 inches diameter is 7 square inches, whereas the surface area of an 8-ounce bottle of a design, such as shown in FIG. 1 of the drawings, and having an inside diameter of 1 inch is 18 square inches. Thus, the bottle may be far more readily heated by placing in hot water since the rate of heating is directly proportional to the surface area available for heat transfer. Furthermore, of course, the shape of the bottle makes it particularly easy for an infant to hold.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A baby bottle comprising:

a generally toroidal hollow chamber;

a bisecting tubular chamber connected at each end thereof to said generally toroidal hollow chamber; and an opening for attachment of a nipple at the outer surface of the generally toroidal hollow chamber at a location generally in line with the bisecting tubular chamber.

2. The baby bottle of claim 1 wherein the inside diameter of the generally toroidal chamber is about the same as the inside diameter of the bisecting tubular chamber.

3. The baby bottle of claim 2 wherein the generally toroidal chamber is toroidal.

4. The baby bottle of claim 1 wherein the generally toroidal chamber surrounds a central circle which lies in a single plane which comprises the central plane of the generally toroidal chamber, and the opening is connected to a generally cylindrical neck portion having a central axis, and the central axis of the neck portion is at an angle of from 20 degrees to 60 degrees with respect to the central plane of the generally toroidal chamber.

5. The baby bottle of claim 4 wherein the central axis of the neck portion is from about 30 to 40 degrees with respect to the central plane of the generally circular chamber.

6. The baby bottle of claim 1 wherein said bottle is formed by blow molding.

7. The baby bottle of claim 1 wherein the capacity of said baby bottle is about 8 fluid ounces.

8. The baby bottle of claim 1 further including a liquid crystal temperature sensing dot having a color change at about 100 degrees Fahrenheit.

9. The baby bottle of claim 8 wherein said liquid crystal dot is positioned in the wall of the bisecting tubular chamber.

* * * * *